US007208208B1

(12) United States Patent
Lane et al.

(10) Patent No.: US 7,208,208 B1
(45) Date of Patent: Apr. 24, 2007

(54) CUSTOMIZABLE FLOOR MAT

(76) Inventors: Tim A. Lane, 5508 W. Wonder Lake Rd., Wonder Lake, IL (US) 60097; Jill Munro, 5508 W. Wonder Lake Rd., Wonder Lake, IL (US) 60097

( * ) Notice: Subject to any disclaimer, the term of this patent is extended or adjusted under 35 U.S.C. 154(b) by 211 days.

(21) Appl. No.: 11/058,644

(22) Filed: Feb. 16, 2005

(51) Int. Cl.
*B32B 3/30* (2006.01)

(52) U.S. Cl. ..... 428/34.1; 428/172; 428/195.1; 428/913

(58) Field of Classification Search ..... 428/34.1, 428/195.1, 172, 913; 15/215–217; 52/177–179
See application file for complete search history.

(56) References Cited

U.S. PATENT DOCUMENTS 3,561,269 A 2/1971 Seitz
3,663,980 A 5/1972 Conklin
4,229,239 A 10/1980 Arai et al.
D306,673 S 3/1990 Steel
5,677,108 A 10/1997 Chia et al.
6,233,776 B1 5/2001 Blum et al.
D464,519 S 10/2002 Fernando
2003/0121448 A1 7/2003 Chen et al.

*Primary Examiner*—Alexander S. Thomas

(57) ABSTRACT

A floor mat includes a rectangular base section that has oppositely spaced edge portions and a planar top surface provided with surface indicia. The base section is formed from durable material to withstand inclement weather conditions. The floor mat further includes a plurality of thermochromic dyes for selectively displaying at least one footprint on the top surface such that the footprint automatically appears and disappears when a temperature of the top surface falls below and above a threshold temperature. A hand-operable actuator is included that has a cavity for holding a selected quantity of fluid therein. The actuator is slidably engageable with the top surface such that the top surface temperature can be regulated by the user.

15 Claims, 2 Drawing Sheets

CUSTOMIZABLE FLOOR MAT

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to floor mats and, more particularly, to a customizable floor mat for improving holiday spirit.

2. Prior Art

Floor mats are known for cleaning the soles of a person's shoes who is about to enter a home, a particular area, or a room. During times of fair weather, the use of such floor mats may not be required. A person may not wish to remove the mat during these times, but rather display it as a decorative item. This requires the presence of indicia on the floor mat to make it more aesthetically pleasing.

Many such floor mats are known in the prior art. People further enjoy decorating their homes for various holiday seasons including Christmas, Easter, Valentine's Day and St. Patrick's Day, to name a few. Each one of these days has certain symbols associated therewith that may be used to decorate a home. Thus, it would be advantageous to have these symbols replicated as indicia on the floor mat so the floor mat is consistent with the other decorations.

Many floor mats have indicia thereon that are visible at all times. There are thus no exciting features that make one stand out from the other. Presenting indicia in a novel manner that is unsuspecting to visitors can improve their holiday spirit while further encouraging visits to the user's home.

Accordingly, a need remains for a customizable floor mat in order to overcome the above-noted shortcomings. The present invention satisfies such a need by providing a floor mat that is easy to display, novel and attractive in design, and reasonably priced. Such a floor mat provides an eye-catching decoration that displays a homeowner's holiday spirit. The floor mat further provides a novel way to decorate an entry way to the house or the interior of a home. The unique indicia make it appear that Santa Claus, the Easter Bunny, or other select holiday figures has actually come by to visit the house. Such indicia bring smiles and laughter to both children and adults, thus making the holiday season even more enjoyable.

BRIEF SUMMARY OF THE INVENTION

In view of the foregoing background, it is therefore an object of the present invention to provide a customizable floor mat. These and other objects, features, and advantages of the invention are provided by a decorative floor mat.

The floor mat includes a substantially rectangular base section having a centrally disposed longitudinal axis and oppositely spaced edge portions extending substantially parallel thereto. Such a base section further has a substantially planar top surface provided with surface indicia conveniently illustrating a predetermined holiday theme. The base section is advantageously formed from durable material to withstand inclement weather conditions.

The present invention further includes a plurality of temperature sensitive colored thermochromic dyes for selectively displaying at least one footprint on the top surface such that the footprint automatically appears and disappears when a temperature of the top surface falls below a threshold temperature. Such thermochromic dyes become transparent above a predetermined temperature and recover their original color strength when a temperature of the top surface falls below a threshold temperature. Such thermochromic dyes are conveniently positioned onto the top section such that the thermochromic dyes are substantially undetectable by a bystander. The thermochromic dyes are preferably positioned for defining at least one footprint adjacent to the surface indicia so that a simulated travel path can be displayed on the top surface while conveniently not disturbing and overlapping the surface indicia.

A hand-operable actuator is included that has a cavity for holding a selected quantity of fluid therein. Such an actuator is slidably engageable with the top surface such that the top surface temperature can effectively be regulated by the user. The actuator may have a star shape and includes a cap attached thereto such that the user may conveniently periodically refill the actuator with chilled fluid as needed. Of course, alternately shaped actuators may be used as is obvious to a person of ordinary skill in the art.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
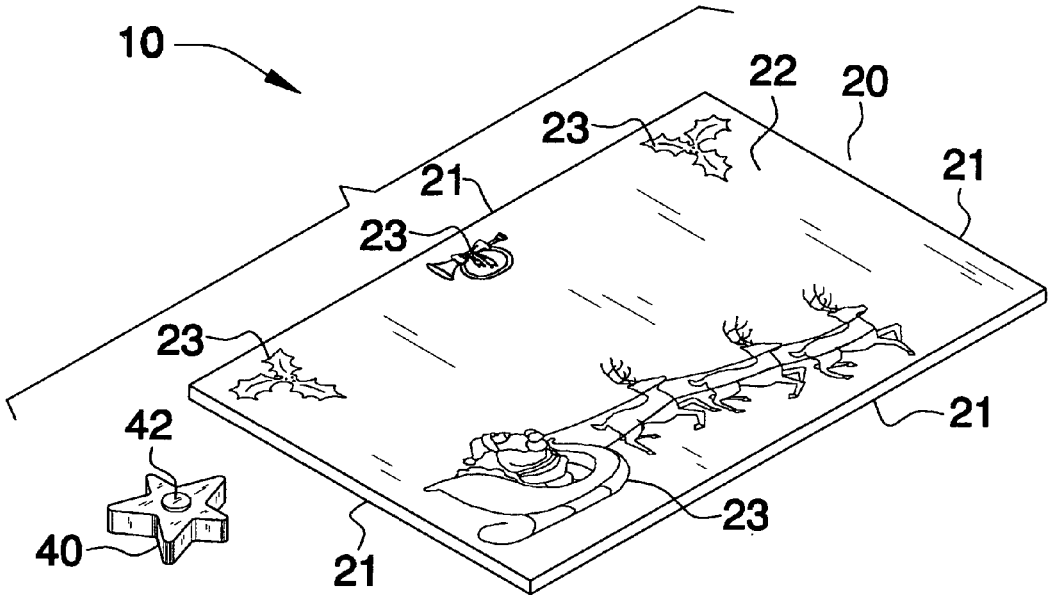
FIG. 1 is a perspective view showing a customizable floor mat and actuator, in accordance with the present invention.

The present invention will now be described more fully hereinafter with reference to the accompanying drawings, in which a preferred embodiment of the invention is shown.

This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to protect a customizable floor mat. It should be understood that the apparatus 10 may be used to decorate for many different types of holiday seasons and should not be limited to only the Christmas season.

Referring initially to FIG. 1, the apparatus 10 includes a substantially rectangular base section 20 having a centrally disposed longitudinal axis and oppositely spaced edge portions 21 extending substantially parallel thereto. Such a base section 20 further has a substantially planar top surface 22 provided with surface indicia 23 conveniently illustrating a predetermined holiday theme. Of course, such a base section 20 may also be formed in holiday shapes such as a star, bell, tree, shamrock, Easter egg, etc., as is obvious to one having ordinary skill in the art. Advantageously, a plethora of different holiday themes may be displayed on the top surface 22 such that the apparatus 10 is not limited to use during only one of many holiday seasons. The base section 20 is advantageously formed from durable material to withstand inclement weather conditions and the constant friction experienced from people cleaning their shoes thereon, thus increasing the useful life of the apparatus 10.

Figure 2:
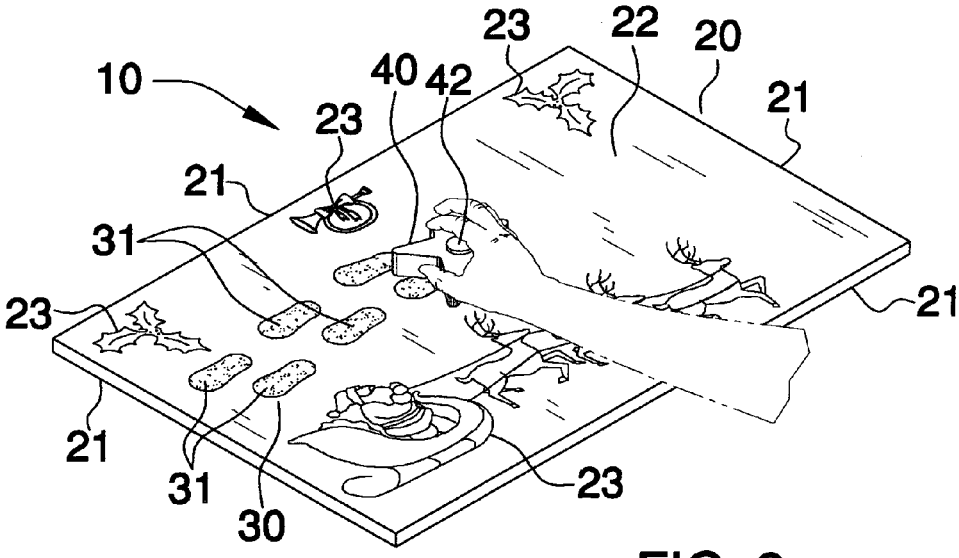
FIG. 2 is a perspective view of the apparatus shown in FIG. 1, showing the actuator and thermochromic indicia during operating conditions.
Figure 3:
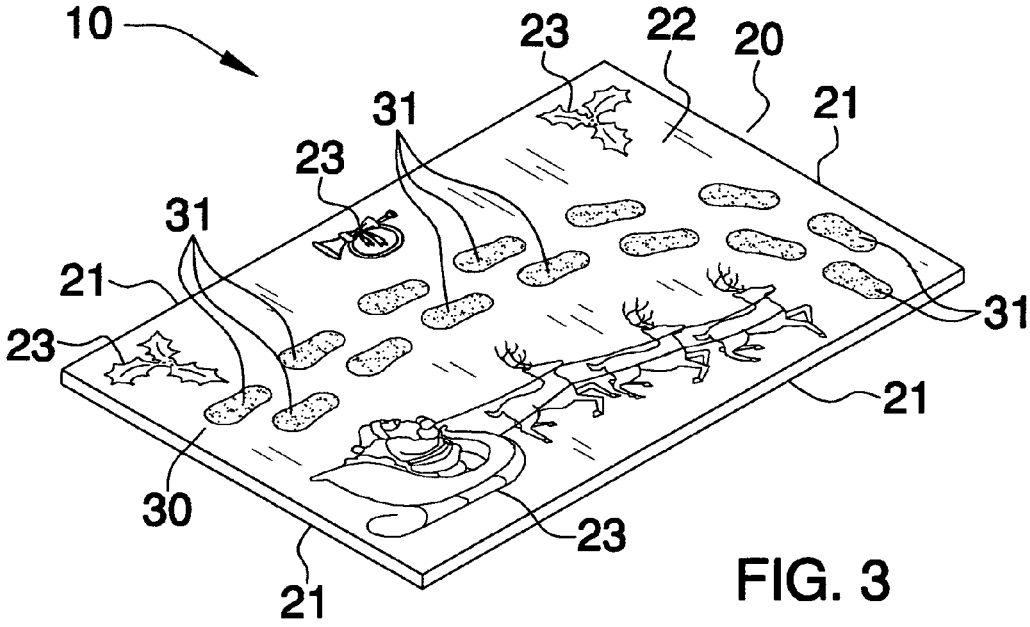
FIG. 3 is a perspective view of the apparatus in FIG. 1, showing the thermochromic indicia completely displayed.
Figure 4:
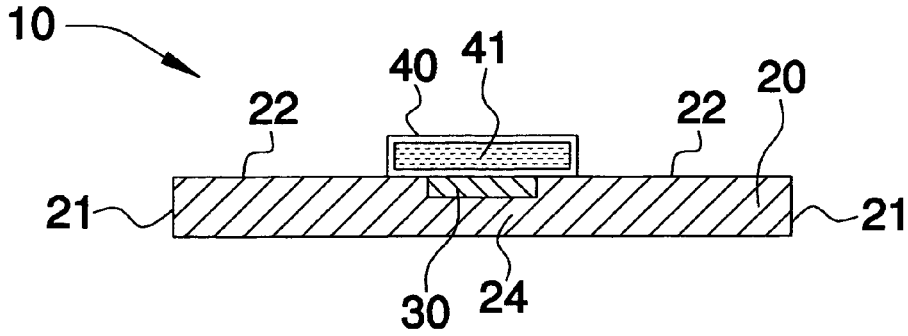
FIG. 4 is a cross-sectional view of the apparatus, showing the thermochromic dyes and actuator.

Referring to FIGS. 2, 3 and 4, the plurality of thermochromic dyes 30 selectively display at least one footprint 31 on the top surface 22 such that the footprint 31 automatically appears and disappears when a temperature of the top surface 22 falls below a threshold temperature respectively. Of course, the shape of the foot print 31 may take many different forms, such as that of boots or animal paw prints, in order to effectively represent the holiday character of the intended season. Such thermochromic dyes 30 are conveniently located such that the thermochromic dyes 30 are substantially undetectable by a bystander. This feature makes it seem that the footprints 31 appear from a holiday character who walked across the base section 20, thus providing exciting entertainment for children during each particular holiday season. Of course, such footprints 31 may represent human or animal footprints, such as reindeer or Easter bunny paws, as is obvious to one having ordinary skill in the art.

Referring to FIG. 4, the thermochromic dyes 30 are preferably positioned onto the top surface 22 for defining at least one footprint adjacent to the surface indicia 23 so that a simulated travel path can be displayed on the top surface 22 while conveniently not disturbing an appearance of the surface indicia 23. The top surface 22 is provided with a groove 24 formed therein and the thermochromic dyes 30 are positioned within the groove 24 such that the thermochromic dyes 30 advantageously become disposed evenly with the top surface 22 and thereby allow the actuator 40 (described herein below) to be smoothly displaced over the top surface 22. This feature further prevents users from accidentally dislodging the thermochromic dyes 30, thus advantageously increasing the effectiveness and practicality of the apparatus 10. Such thermochromic dyes 30 and the surface indicia 23 are non-overlapping, so the indicia 23 do not become obscured by the thermochromic dyes 30 during operating conditions.

Referring to FIGS. 1, 2 and 4, a hand-operable actuator 40 is included having a cavity 41 for holding a selected quantity of fluid therein. Such an actuator 40 is slidably engageable with the top surface 22 so the top surface temperature can effectively be regulated by the user. The actuator 40 may have a star shape and includes a cap 42 attached thereto such that the user may conveniently periodically refill the actuator 40 with chilled or heated fluid as needed. Of course, alternately shaped actuators 40 may be used as is obvious to a person of ordinary skill in the art. Such an actuator 40 advantageously allows a user to activate or deactivate the thermochromic dyes 30 when ambient air conditions are not suitable.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A decorative floor mat comprising:

a base section having a centrally disposed longitudinal axis and oppositely spaced edge portions extending substantially parallel thereto, said base section further having a top surface provided with surface indicia illustrating a predetermined holiday theme, said base section being formed from durable material to withstand inclement weather conditions;

means for selectively displaying at least one footprint on said top surface such that said at least one footprint automatically appears and disappears when a temperature of the top surface falls below a threshold temperature; and a hand-operable actuator having a cavity for holding a selected quantity of fluid therein, said actuator being slidably engageable with said top surface such that said top surface temperature can be regulated by the user.

2. The floor mat of claim 1, wherein said displaying means comprises:

a plurality of thermochromic dyes positioned onto said top surface, said dyes for defining said at least one footprint adjacent to said surface indicia so that a simulated travel path can be displayed on said top surface while not disturbing an appearance of said surface indicia.

3. The floor mat of claim 2, wherein said top surface is provided with a groove formed therein, said thermochromic dyes being positioned within the groove such that said thermochromic dyes become disposed evenly with said top surface and thereby allow said actuator to be smoothly displaced over said top surface.

4. The floor mat of claim 2, wherein said thermochromic dyes and the surface indicia are non-overlapping.

5. The floor mat of claim 1, wherein said actuator has a star shape and includes a cap attached thereto such that the user may periodically refill said actuator with chilled fluid as needed.

6. A decorative floor mat comprising:

a substantially rectangular base section having a centrally disposed longitudinal axis and oppositely spaced edge portions extending substantially parallel thereto, said base section further having a substantially planar top surface provided with surface indicia illustrating a predetermined holiday theme, said base section being formed from durable material to withstand inclement weather conditions;

means for selectively displaying at least one footprint on said top surface such that said at least one footprint automatically appears and disappears when a temperature of the top surface falls below a threshold temperature; and a hand-operable actuator having a cavity for holding a selected quantity of fluid therein, said actuator being slidably engageable with said top surface such that said top surface temperature can be regulated by the user.

7. The floor mat of claim 6, wherein said displaying means comprises:

a plurality of thermochromic dyes positioned onto said top surface, said thermochromic dyes for defining said at least one footprint adjacent to said surface indicia so that a simulated travel path can be displayed on said top surface while not disturbing an appearance of said surface indicia.

8. The floor mat of claim 7, wherein said top surface is provided with a groove formed therein, said thermochromic dyes being positioned within the groove such that said thermochromic dyes become disposed evenly with said top surface and thereby allow said actuator to be smoothly displaced over said top surface.

9. The floor mat of claim 7, wherein said thermochromic dyes and the surface indicia are non-overlapping.

10. The floor mat of claim 6, wherein said actuator has a star shape and includes a cap attached thereto such that the user may periodically refill said actuator with chilled fluid as needed.

11. A decorative floor mat comprising:

a substantially rectangular base section having a centrally disposed longitudinal axis and oppositely spaced edge portions extending substantially parallel thereto, said base section further having a substantially planar top surface provided with surface indicia illustrating a predetermined holiday theme, said base section being formed from durable material to withstand inclement weather conditions;

means for selectively displaying at least one footprint on said top surface such that said at least one footprint automatically appears and disappears when a temperature of the top surface falls below a threshold temperature, said displaying means being located at a stealthy position such that said displaying means is substantially undetectable by a bystander; and a hand-operable actuator having a cavity for holding a selected quantity of fluid therein, said actuator being slidably engageable with said top surface such that said top surface temperature can be regulated by the user.

12. The floor mat of claim 11, wherein said displaying means comprises:

a plurality of thermochromic dyes positioned onto said top surface, said thermochromic dyes for defining said at least one footprint adjacent to said surface indicia so that a simulated travel path can be displayed on said top surface while not disturbing an appearance of said surface indicia.

13. The floor mat of claim 12, wherein said top surface is provided with a groove formed therein, said thermochromic dyes being positioned within the groove such that said thermochromic dyes become disposed evenly with said top surface and thereby allow said actuator to be smoothly displaced over said top surface.

14. The floor mat of claim 12, wherein said thermochromic dyes and the surface indicia are non-overlapping.

15. The floor mat of claim 11, wherein said actuator has a star shape and includes a cap attached thereto such that the user may periodically refill said actuator with chilled fluid as needed.

* * * * *